United States Patent [19]

Lindquist

[11] 4,177,994

[45] Dec. 11, 1979

[54] GOLF GAME AND PRACTICE APPARATUS

[75] Inventor: Everet F. Lindquist, Iowa City, Iowa

[73] Assignee: University of Iowa Research Foundation, Iowa City, Iowa

[21] Appl. No.: 752,022

[22] Filed: Dec. 20, 1976

[51] Int. Cl.[2] ..... A63B 69/36

[52] U.S. Cl. ..... 273/176 FA; 273/181 E; 273/185 B

[58] Field of Search ..... 273/181 E, 185 R, 185 A, 273/185 B, 184 R, 176 FA

[56] References Cited

U.S. PATENT DOCUMENTS

| | | | |
|---|---|---|---|
| 2,581,738 | 1/1952 | Williams | 273/185 B X |
| 2,894,750 | 7/1959 | Simjian | 273/185 A X |
| 3,072,410 | 1/1963 | Simjian | 273/185 A |
| 3,091,466 | 5/1963 | Speiser | 273/185 R |
| 3,591,184 | 7/1971 | Conklin | 273/181 E |
| 3,778,064 | 12/1973 | Nutter | 273/185 B X |
| 3,814,438 | 6/1974 | Baron et al. | 273/185 R X |

FOREIGN PATENT DOCUMENTS

| | | | |
|---|---|---|---|
| 494840 | 11/1938 | United Kingdom | 273/181 E |

*Primary Examiner*—George J. Marlo
*Attorney, Agent, or Firm*—James C. Nemmers

[57] ABSTRACT

An apparatus for simulating the game of golf and aiding golfers in improving their game by providing an indoor practice facility. The apparatus employs a unique penetrable grid consisting of parallel spaced-apart conductors in one plane positioned ahead of a second group of conductors in a second plane parallel to the first plane. The conductors are connected in an electrical circuit, and when the grid is struck by a golf ball, a conductor in one group engages a conductor in the other group thereby producing a signal that is used to provide an accurate measurement of the direction and velocity of the golf shot. The electrical circuit includes diodes and electrical connections to a units lead and a tens lead. Each pair of units and ten leads is connected to the detecting means. The detecting means includes latches to detect the contact of the first ones of the conductors in the first and second planes. A screen is positioned behind the penetrable grid in order to stop the flight of driven golf balls, and provide a surface on which images of a golf course may be projected. Using this apparatus, the lie of the golf ball resulting from that shot can be predicted and plotted on a map of the golf course. The basic procedure employed using the apparatus can be repeated to simulate play over an entire golf course.

10 Claims, 3 Drawing Figures

GOLF GAME AND PRACTICE APPARATUS

BACKGROUND OF THE INVENTION

In recent years, the game of golf has attracted millions of golfers throughout the United States and is gaining popularity in many foreign countries. The vast majority of these golfers are leisure-time golfers who play the game with insufficient frequency to rapidly improve their scores. However, even the leisure-time golfers consider the game a highly competitive sport and are always looking for ways to easily lower their scores. Improvement generally requires many hours of practice, and few golfers have access to good practice facilities. Even if facilities for practicing the game are available, practice by simply driving the ball into a net, driving a ball into a driving range without having a specific target or without knowing exact distances, or practice without any information concerning the timing of the golfer's swing or his possible "hook" or "slice" may do little to improve the golfer's game. Practice on a golf course itself is practically an impossibility because of the crowded conditions of most courses and because of the limited amount of time the average leisure-time golfer has to devote to improving his golf game.

When the foregoing difficulties are coupled with the relatively short outdoor playing season that exists throughout most of the United States, there is a need for any means that will make it convenient for the golfer to improve his game either through practice or by extending the available hours for play. Many attempts have been made to provide means and facilities for allowing a golfer to practice and "play" indoors. What may be the best of these attempts have resulted in apparatus and devices which have not developed commercially because thay are too costly for the average golfer and are too difficult to maintain. The less costly prior art devices and apparatus which have been tried have done little to improve a golfer's game and in some instances have even encouraged bad playing habits. Other prior art devices and apparatus have failed commercially because they have not been able to simulate sufficient realism or have not provided a means for determining reasonably accurate estimates of range and lie of each golf shot.

There is, therefore, a definite need for any device or apparatus which can be used primarily indoors and which can provide a golfer with enjoyable recreation while at the same time providing definite and measurable improvement of all of the various strokes employed in the game of golf. Any such device must of course provide sufficient realism of play in order to maintain the golfer's interest and must also be of a design that can be marketed at a price attractive to the average leisure-time golfer.

SUMMARY OF THE INVENTION

The apparatus of the invention consists essentially of a rectangular frame on which are strung a grid of virtually invisible fine steel wires. The grid is made up of parallel horizontal wires in one plane and parallel vertical wires in another plane parallel to the first plane. The grid is positioned ahead of a backstop upon which there may be projected selected views of an actual golf course. At a predetermined fixed distance in front of the grid, there is provided a tee or a simulated fairway surface. Appropriate side panels may be also provided to deflect any wild shots toward the grid. Using regulation golf balls and clubs, balls are driven through the grid. As the ball leaves the driving area, a light beam is broken and an electronic timer started, which timer is stopped as the ball passes through the grid and forces a vertical wire into contact with a horizontal wire immediately behind it in the path of the ball. By means of a high speed electronic switching circuit, there can be determined from the coordinates of the point of impact the initial angle of elevation of the golf shot, the initial angle of deviation, and (from the time required for the ball to reach the grid) the initial velocity of the ball and the estimated carry of the ball. With these data, the lie of the ball can be estimated with reasonable accuracy and if desired plotted on a map of the actual golf course "being played". In this manner a golfer can simulate actual play, or the apparatus can be used as a very effective means of improving the golfer's strokes.

DESCRIPTION OF THE PREFERRED EMBODIMENT OF THE INVENTION

The preferred emboiment of the invention which is described in detail hereinafter satisfies a number of basic requirements which are essential for an apparatus that will truly provide effective practice and simulated realism. To be effective, an apparatus or device useful in practice must provide the golfer with the ability to execute each shot exactly as it should be executed in actual play. Furthermore, in order that the golfer may receive the maximum benefit from practice, the golfer should receive an immediate "feed-back" of information to enable him to know the degree of success or failure of his shot. In other words, the golfer should know at once the accuracy of his shot, how far his ball would have carried, where his ball landed and came to rest, whether he hooked or sliced, pulled or pushed his shot, whether or not his timing was good, etc., in a manner similar to or superior to knowledge he would have in actual play.

As he does in actual play, the golfer should always be attempting to hit the ball a predetermined distance in the direction of a specific target. Therefore, any worthwhile simulator should provide the golfer with the means of selecting a target at a known distance. With the apparatus of the invention, the golfer selects his target in the projected photograph of the course so that in practice he is always trying to place his ball in a most favored lie for the next shot.

Obviously, any apparatus that either simulates play or provides meaningful practice must be highly accurate and dependable. A golfer who uses incorrect or inaccurate information in an attempt to modify his technique may worsen his game rather than improve it.

Figure 1:
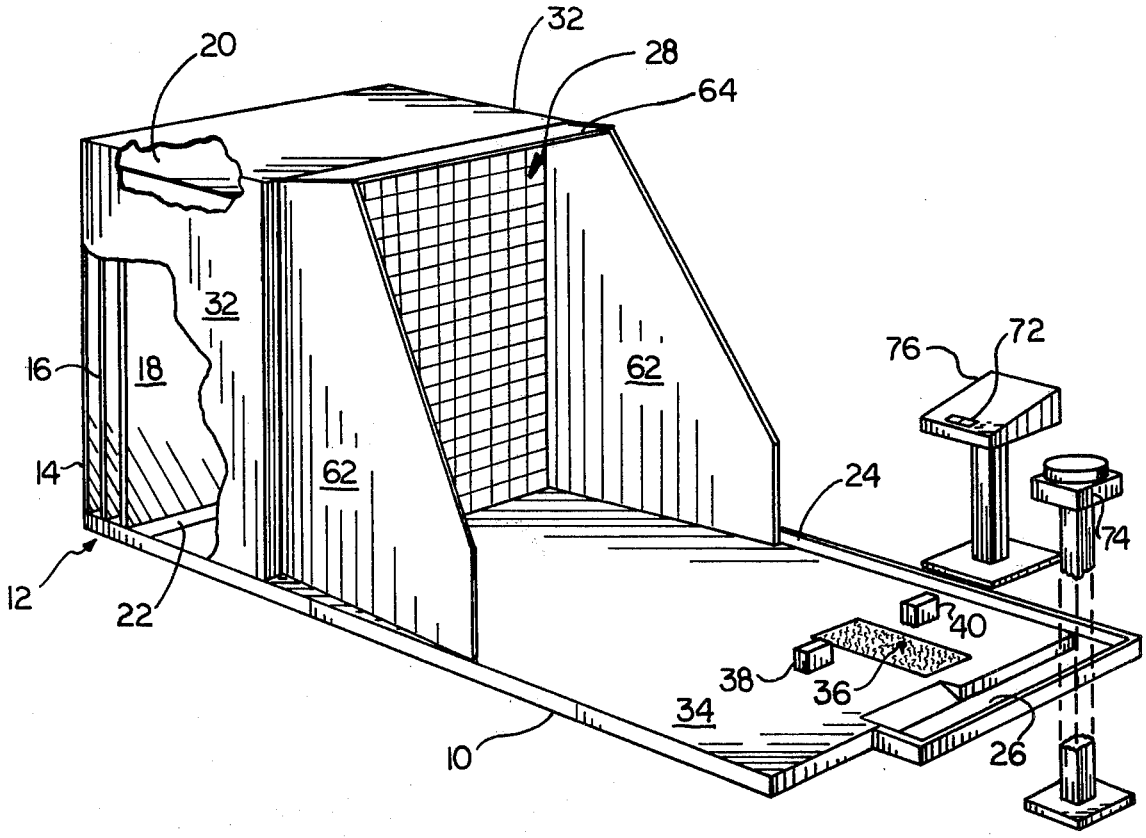
FIG. 1 is a perspective view of an apparatus constructed according to the principles of the invention.

The apparatus of the invention, which will now be described, meets the foregoing basic requirements and, therefore, makes available a simulator and practice apparatus which will be of use to every golfer regardless of his present level of ability. Referring now to FIG. 1, there is shown a preferred embodiment of the invention in the form of a self-contained and easily movable unit.

The unit consists of a base 10 at the rear of which is a suitable backstop 12 which serves as a backstop for the golf balls and also serves as a screen on which can be projected photographs of the golf course being "played". The backstop 12 may be a multi-layer curtain, with three such layers being shown in FIG. 1. While for purposes of illustration, FIG. 1 shows these layers spaced apart several inches, it is preferred that they actually be positioned almost in contact with one another. The rear-most layer 14 preferably is of heavy material, such as canvas or carpeting, which serves as a positive stop for the balls. An optional middle layer 16, to prolong the life of the backstop, is preferably woven of extremely strong cord such as nylon, and the front layer 18 preferably consists of a white sheet of strong flexible material (such as nylon satin or double-knit nylon fabric) which serves as a screen upon which an image can be projected. The two rear layers 14 and 16 are preferably free-hanging from a suitable supporting frame 20, while the forward layer 18 is preferably stretched smooth by attaching the sheet material to the frame 20 around its entire perimeter. The support frame 20 is, of course, suitably secured to the base 10 so that the frame 20 will be in a substantially vertical position. The front layer 18 which forms the screen preferably should be secured around its perimeter to the frame 20 by suitable resilient means so that after a ball strikes the screen 18 the screen will immediately return to its smooth condition.

Balls striking the foregoing described multi-layer backstop 12 will rebound very little if at all, and therefore will drop downwardly immediately to the front of the screen 18. There is provided in the base 10 a channel 22 extending parallel to the screen 18 and sloping from one side of the base to the other (left to right of FIG. 1) so that the balls, after striking the backstop 12, will roll downwardly to the right side of the base 10. At this point, the balls can be propelled by any suitable means along a second channel 24 that extends longitudinally of the base 10 along its right edge. Of course, the base 10 can be constructed so that the balls will roll entirely under the force of gravity rather than providing any propelling means to assure return of the balls from channel 22 along channel 24 to a storage area 26 located at the side of or at the most-forward edge of the base 10.

Forwardly of the backstop 12 (approximately 1'-2') and parallel to it there is located a grid indicated generally by the reference numeral 28. Grid 28 includes a suitable frame 30 (FIG. 2) which is secured in a vertical position on base 10 and parallel to backstop 12. The recommended size of the frame 30 is 6'×9', but obviously a smaller or larger frame can be employed if desired. If desired, suitable panels 32 may be provided to enclose the area between the grid 28 and the backstop 12, such panels 32 being shown in FIG. 1 as covering the sides and top of the apparatus between the backstop 12 and the grid 28. Panels 32 are preferably of a durable material such as canvas and serve to contain and deflect any golf balls into the backstop so that they do not rebound toward the golfer. The panels 32 should be mounted so as to prevent any balls from striking the surface of the screen 18 near its edges, where greater rebound would result. The panels 32 also serve as a "shadow box" to prevent light from reaching the screen 18 except such light as may be projected upon the screen. This thus allows the apparatus to be used in a well lighted room without diminishing the brilliance of the image projected on the screen.

To make the apparatus easily movable, the backstop 12 and grid 28 may be constructed so that each of them can be conveniently detached from the base 10 and folded vertically in the middle. The base 10 also may be foldable, so as to occupy less storage space and easily moved through normal-sized doors. Of course, the panels 32 can also easily be hingedly attached to the support frame 20 and grid frame 30 in a suitable manner so to allow them to be quickly and easily folded. Specific means of attachment to enable the apparatus to be folded into a compact unit are well within the scope of persons skilled in the art and specific means are thus not shown. However, preferably such means are provided which will permit the apparatus of the invention to be compactly stored and easily moved from one location to another.

At the forward end of the base 10 is the player station 34 which is of a suitable area to permit a golfer to freely swing any club without interference. Within the player station 34 (recommended 100" from grid 28), there is provided a suitable area, such as a simulated turf surface (details not shown) or a tee 36 upon which to rest a golf ball. Located on opposite sides of the tee 36 are a pair of housings 38 and 40. Housing 38 contains a suitable light source that will produce two light beams, one approximately ¼" above the simulated turf surface of the base 10 and another about 1½" above such surface. The other housing 40 contains two light sensors, such as phototransistors, which sensors are in alignment and shielded so as to receive the respective ones of the light beams from the housing 38. The beams of light from housing 38 are so positioned that a golf ball hit from tee 36 will interrupt at least one of the light beams. An alternative light beam system (not shown) could employ a light source suspended above the player station 34 with several light sensors positioned in the base 10 a few inches ahead of the tee 36. This arrangement provides a "fan" of near-vertical beams ahead of the ball at least one of which beams will be interrupted by the flight of a golf ball producing the effect described hereinafter. This alternate system has the advantage in that it leaves the floor clear of housings 38 and 40 which might inhibit the golfer in making a free swing. The effect of interrupting the light beams will be described more fully hereinafter.

FIG. 1 is intended only to suggest the general nature of the elements of the total device which are needed to make the grid 28 functionable in an indoor apparatus, and no attempt has been made to indicate optimal dimensions or orientation of all of the elements.

Figure 2:
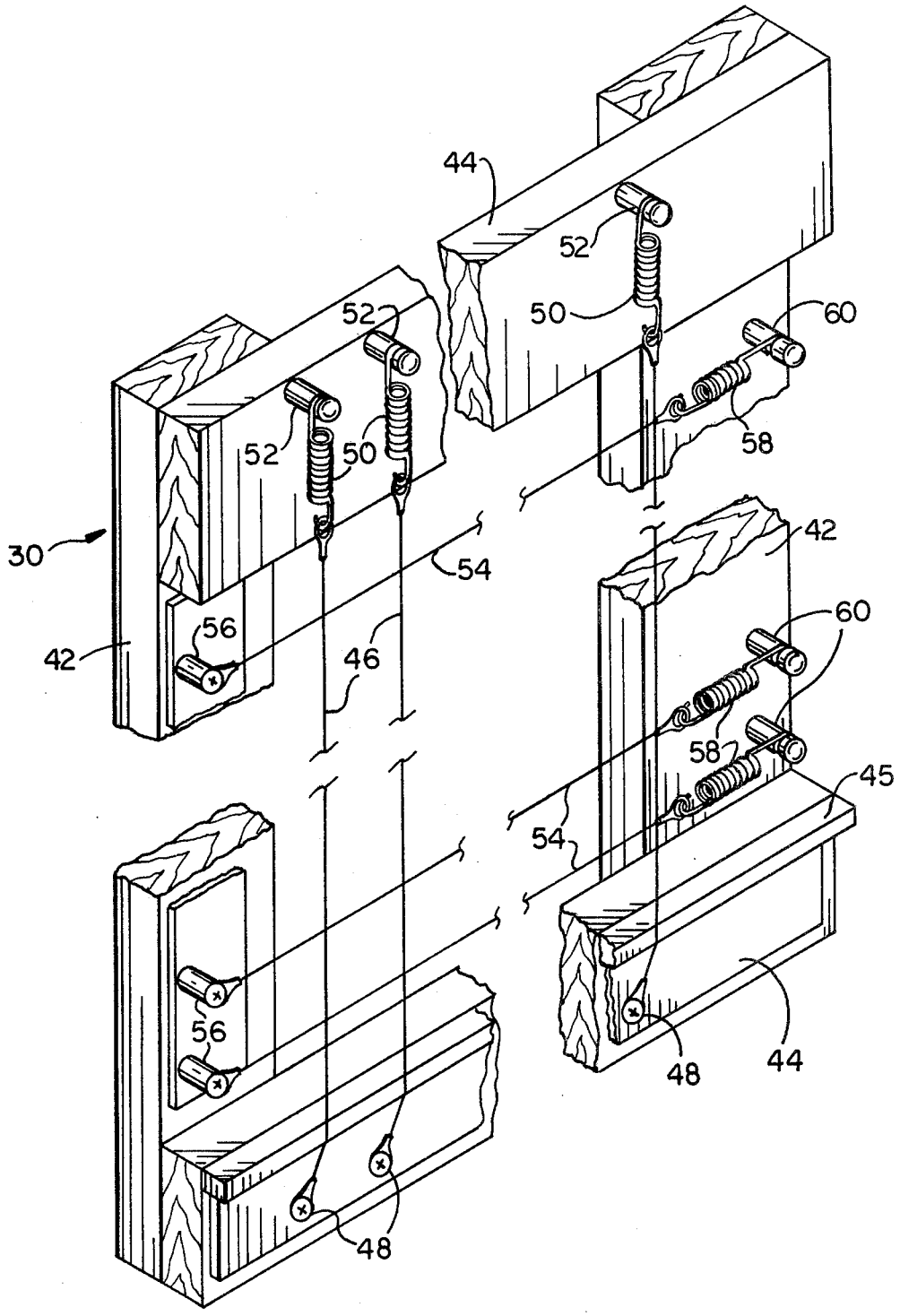
FIG. 2 is a perspective view with parts broken away to show the details of the penetrable grid.

The frame 30 is specially constructed to support a plurality of fine wires in two separate planes. Thus, the frame consists of two vertically-extending frame members 42 and upper and lower horizontally-extending frame members 44, the front surfaces of which are forward of the front surfaces of the side frame members 42. This is best shown in FIG. 2 with the spacing of the frame members 42 and 44 somewhat exaggerated. Stretched at equal intervals across the horizontal frame members 44 is a group of vertical wires 46 which are all parallel to each other and in the same plane. Each wire 46 is attached at its lower end to an insulated electrical binding post 48 and at its other end to a resilient means such as spring 50 (or a rubber band) which is in turn secured to a supporting post 52.

Similarly, at equally spaced intervals across the side frame members 42 there is a group of horizontal wires 54 parallel to each other and all located precisely in the same plane. Each wire 54 is secured at one end to an insulated metal support 56 and at its other end to a spring 58 which is in turn connected to a supporting post 60 secured to one of the side frame members 42.

Although wires 46 are shown vertically extending and wires 54 horizontal, the grid 30 will function with the wires oriented in a different manner, and even if they are not equally spaced apart and parallel. It is only essential that one group of wires in one plane be closer to the player station 34 than the other group, with the groups separated a distance within the elastic limit of the wires as noted hereinafter.

Each of the vertical wires 46 and horizontal wires 54 are preferably of a fine piano wire. For example, #6 piano wires about 10/1000 of an inch in diameter are suitable, and both the vertical wires 46 and horizontal wires 54 are spaced at 1" intervals. The plane in which vertical wires 46 are located is parallel to and spaced a fraction of an inch from the plane in which horizontal wires 54 are located. The spacing of the planes must be sufficiently close to allow a wire in the forward plane to contact a wire in the other plane when struck by a ball without the wire distorting. The spacing of these two planes might be, for example, one-fourth of an inch. It is essential that the horizontal wires 54 in the rear plane is held precisely in the same plane, and thus each of the horizontal wires should be stretched rather tightly but well below the limit of elasticity for the material out of which the wires 54 and springs 58 are constructed, and should be held in the same plane by passing over insulated rigid straight rods which press lightly against the wires at each end. This is described hereinafter. The vertical wires 46 which form the front plane of the grid should also be stretched tightly and straight. Normally the golf ball strikes only one, and never more than two, of the vertical wires 46, and therefore there is seldom any question which of the vertical wires 46 makes contact with a horizontal wire 54. In order to maintain the wires 46 and 54 in a precise plane, the frame 30 is provided with an insulated, straight, very rigid rod 45, preferably of rectangular cross section, across which each end of each wire is stretched. Such a rod 45 is shown affixed to the lower member 44 of the frame 30, and for the sake of simplicity, FIG. 2 shows only one such rod 45. However, the complete grid 30 would include four such rods 45, one near each end of both sets of wires 46 and 54. Each rod 45 presses lightly against the wires near their ends, only enough to contact all wires and thus insure that every wire in each group is precisely contained in the same plane. Finally, by adjusting the rearward or forward positions of these rods 45, the distance between the two planes can be precisely determined as desired.

Preferably there is also hinged to each side of the grid frame 30 wings 62 (FIG. 1) to deflect stray golf shots into the grid 28. Wings 62 are preferably positioned at an angle inwardly so as to deflect the golf ball directly into the grid without the danger of ricocheting the ball back toward the golfer. Also, wings 62 should be mounted so as to prevent any balls from striking the surface of the grid 28 near its edges or near the anchored ends of wires 46 and 54, where the wires are less easily pushed apart by the ball, and, therefore, are more likely to be distorted by a direct hit by a ball. Similarly, an overhanging panel 64 is provided along the top of the grid 28 extending between the wings 62 so as to deflect any stray high golf shots. The wings 62 also serve to support the grid 28, and wings 62 and overhang 64 are preferably hinged so that they can be quickly folded against the grid 28 when it is desired to store or move the unit. In order to simplify the illustrations, the dimensions and angles of these panels are not optimally shown in FIG. 1.

Figure 3:
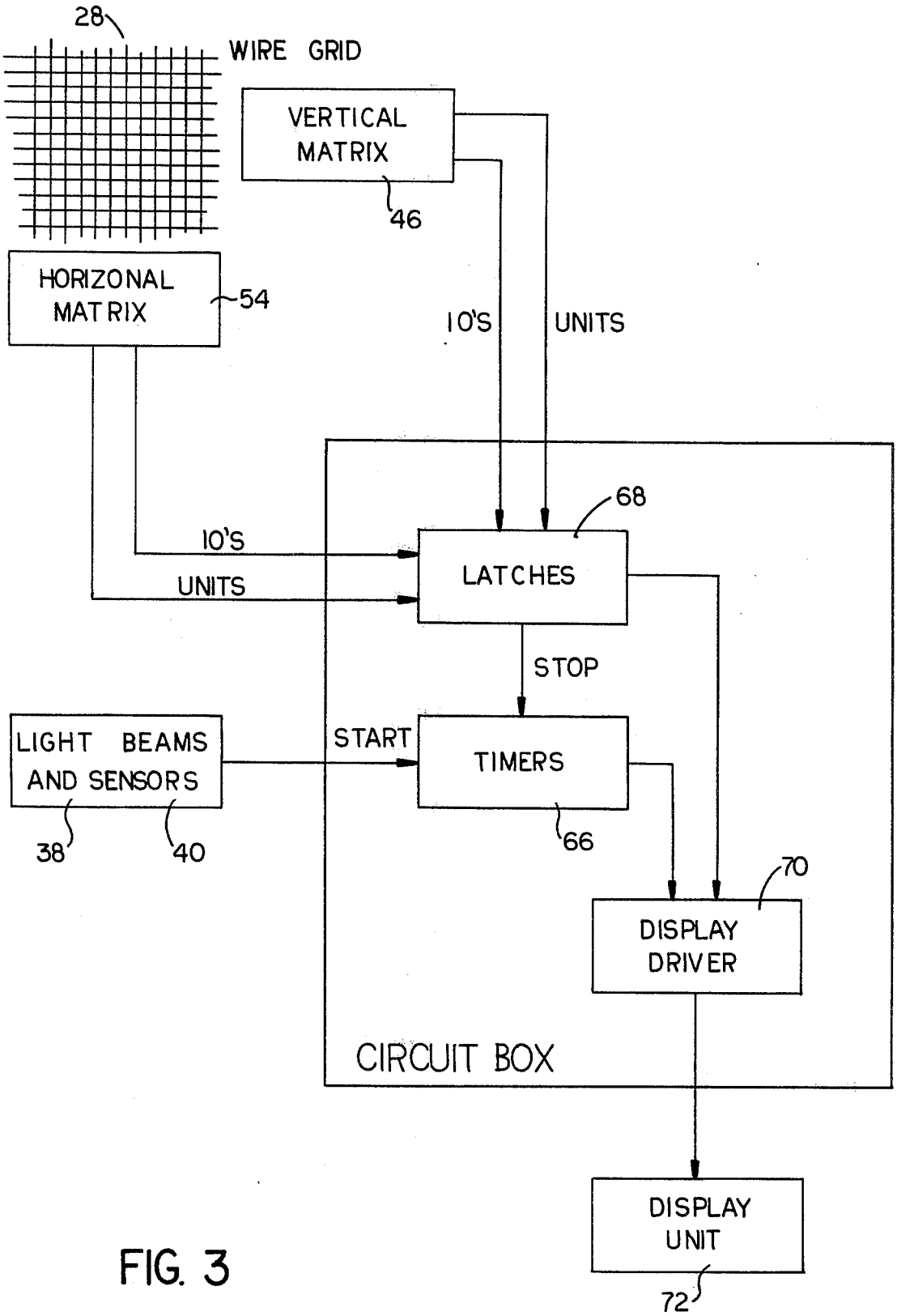
FIG. 3 is a schematic diagram showing the basic electronic circuitry in a diagrammatical form.

The foregoing described basic apparatus is also combined with the appropriate electrical circuitry that assists in measuring the initial velocity and the angles of projection and deviation of each golf shot. A diagrammatical view of the basic circuity is illustrated in FIG. 3. In order to ready the device for a golf shot, a golf ball is placed on the tee 36 or on the simulated turf surface provided by base 10, just behind the horizontal light beams from housing 38. When the ball is struck, it will interrupt one of the two light beams from housing 38, which interruption will be sensed by one of the sensors in housing 40 and thus start an electronic timer 66 (FIG. 3). When the ball reaches the grid 28, it will easily pass through the wire grid, usually with no appreciable retardation or deflection occurring. However, because of the spacing of the wires 46 and 54, the ball will always force one of the front or vertical wires 46 against one of the rear or horizontal wires 54, thus completing an electrical circuit in the manner described hereinafter. As the ball continues its flight through the grid 28, the vertical wire 46 that is first contacted (at the most two vertical wires 46 may be contacted and pushed rearwardly) may come into contact with a number of horizontal wires 54. However, with the circuitry of FIG. 3, the first contact between a vertical wire 46 and a horizontal wire 54 with complete a circuit to stop the electronic timer 66 and to break the circuits to all of the remaining wires. This requires high-speed, priority circuitry with rapid switching to avoid any ties between the first contact and subsequent contacts with the resulting inaccuracy or ambiguity in the read-out.

The circuitry of FIG. 3 is provided with a power supply (not shown). Each of the vertical wires 46 and each of the horizontal wires 54 is connected at its fixed end (the end connected to the insulated support post) through diodes (not shown) in a (horizontal) matrix to two leads which are in turn connected to the latches 68 in the manner described hereinafter. Commencing at one corner of the wire grid 28 (for example, the lower left corner) each of the vertical wires and each of the horizontal wires is numbered consecutively starting with 0. The lower left corner of the grid 28 is thus the origin of a system of coordinates, the grid 30 forming the upper right quadrant, the first wire 46 to the left representing the Y-axis and the bottom horizontal wire 54 the X-axis. One of the leads from each of the horizontal wires is connected through a diode (not shown) to a "units" lead numbered 0 through 9 in the matrix. The other of the leads from each of the horizontal wires 54 is connected through diodes (not shown) to a "tens" lead numbered from 1 to x, depending upon the number of wires in the grid. The vertical wires 46 are similarly numbered, with each pair of leads for each vertical wire 46 being connected respectively through diodes (not shown) to units and tens leads in the (vertical) matrix. The units and tens leads from the vertical diode matrix and the horizontal diode matrix are then in turn connected to the latches 68 as illustrated in FIG. 3.

Assuming a ball has struck the grid 28 and caused initial contact between vertical wire 31 and horizontal wire 28, a circuit will be closed allowing current to flow from the power supply to the vertical number "3" tens lead and the vertical number "1" units lead into the latches 68. Similarly, current will flow through the horizontal number "2" tens lead and the horizontal number "8" units lead also from the latches 68. This will activate the display driver 70 to produce a visual digital read-out in the display unit 72 showing the vertical and horizontal coordinates "31" (Y) and "28" (X), respectively. Simultaneously, latches 68 will deactivate timer 66 which occurs the instant the first contact is made between a vertical wire 46 and a horizontal wire 54. This in turn will activate the display driver 70 and in turn provide a visual read-out on the display unit 72 of the elapsed time between the time a ball was struck and the first contact was made between a vertical and a horizontal wire.

The diodes in each vertical matrix and horizontal matrix as well as latches 68 serve to prevent any feedback or "cross-talk" in or out of the circuit the instant contact is made between the first vertical wire 46 and a horizontal wire 54. In other words, after the initial contact is made between a vertical wire 46 and a horizontal wire 54, subsequent contacts between additional vertical and horizontal wires resulting from the same golf shot will not affect the read-out.

The elapsed time between breaking of a light beam from light source 38 and the first contact between a vertical wire 46 and a horizontal wire 54 is measured within less than half a microsecond, but is "read-out" on display unit 72 in ten-thousands of a second. Since the distance between the grid 28 and the tee 36 is fixed, the initial velocity of the golf ball may be calculated with an error of less than half of one percent (assuming a linear path from tee to grid). Also, using the read-out of the coordinates on the grid 28, the angle of loft or elevation and the angle of deviation (to the right or left) may be determined within one-half of one degree. Using these determinations of the initial velocity and trajectory of the golf shot, the distance the ball travels through the air before impacting the ground (the "flight" or "carry") can be predicted.

The three numbers "read-out" electronically on display unit 72 are the "x" and "y" coordinates of the point at which the golf ball passes through the grid 28, and the time (t) required for the ball to travel from the interrupted light beam produced from housings 38 and 40 to the grid 28. The accuracy with which the "carry" and roll of the ball, and thus its subsequent "lie" on the course may be estimated, depend upon the validity of the mathematical theory and/or procedures employed in estimating trajectories and distances. Because of the inadequacies of the best of previously available theory, the inventor has devised an estimating procedure which overcomes many of the inadequacies of the known theories. This procedure, however, does not form a part of the invention disclosed herein but by using the data obtained from the apparatus of the invention, the ultimate "lie" of the ball can be predicted.

Thus, an extremely important feature of this grid 28 is that it may be set up outdoors on a driving range or golf course, and observations may be made, not only of x, y and t (describing the early part of the actual trajectory of the ball), but direct measurements may be made of the actual carry and roll of each shot of a large number of shots made through the grid 28. The actual relationships between y and t and C and R (carry plus roll) may then be plotted for a large number of shots with each club in terms of points on a system of coordinates, and "lines of best fit" may be fitted to these observations. From these lines of best fit, empirical tables may be read for use in predicting C (or R) from t for various values of y. Alternatively, the curved lines of best fit can be broken up into a small number of segments for each of which a straight line represents a good fit. The simple linear equations (of the form $C=k_1t+k_2$) may then be determined for each straight line segment, and the resulting small number of these simple equations can then be used to predict C and R from x, y and t in the indoor situation. Thus, the entire trajectory of any shot can be estimated from direct and accurate measurements of the early part of the same trajectory. Since the relationship between a part of the actual trajectory and the whole is bound to be higher than the relationship between any theoretical function of causitive factors (such as initial velocity, initial loft, initial spin and axis of rotation, etc.) based on arbitrary assumptions, one can practically guarantee that the accuracy of predictions based on empirical tables or equations using grid observations of the kind here described cannot possibly be exceeded by the use of any presently available theoretical formulas.

The most unique and original feature of the foregoing described apparatus is that the golf ball produces the necessary electrical contact while passing through the grid 28. The force required to push either a vertical wire 46 or a horizontal wire 54 sideways is typically a small fraction of an ounce, and both the deflective force and retarding force are usually entirely negligible. If hard-covered golf balls that are unscarred are used, the balls will pass through the grid 28 without any difficulty. If a wire is struck squarely enough to force the wire backwards any significant distance, the worst than can happen is that one of the springs 50 or 58 could be broken. However, this is unlikely, and if it does occur repair can be quickly and easily made. The use of high quality solid state components in the electronic circuitry guarantees the reliablity and ruggedness of the entire system.

Several prior art devices employ wire grids contained behind a projection screen and immediately backed by a back stop, but such devices do not permit the ball to pass through the grid. Such devices inevitably result in permanent distortions in the wires which produce undependable and inaccurate contacts between the wires and incorrect readouts. With the device of the invention, the ball will slip easily between vertical and horizontal wires in the grid 28, pushing them aside as required, without damaging or distorting the wires. If the ball is deflected or retarded in passing through the grid 28, no effect on the read-out results. It is this "contact-while-passing-through" feature, combined with a very fast-acting priority circuit, that uniquely distinguishes the device of the invention from the prior art.

Although the apparatus as described can be used as a very effective indoor practice aid, it may be desirable to provide the golfer with a "target". There is thus provided a carousel projector 74 located in a suitable position so as to project a suitable image on the screen 18. If desired, projector 74 may be suspended from the ceiling on a suitable support at about eye level to the golfer and one or two feet from him as he addresses the ball, so that the player himself does not interfere with the projection or cast any shadows on the screen. The light source for the vertical light beams (when used in place of the horizontal beams from housing 38) would then be affixed to the bottom of the suspended projector support. Also, a stand 76 may be provided to contain the display unit 72 and provide a working surface upon which a map of a golf course can be placed. A map of the course could alternately be projected on a separate screen. The projector 74 may be manually operated or remotely operated by a push button (not shown) located convenient to the player station 34. Of course, if desired, the projector 74 may be automatically operated by computer. In any event, it is an important consideration that the relationship between depth of focus of the camera used, depth of focus of the projector 74, and the distances of player and projector from the screen 18 are together such as to give maximum realism and to allow the player to judge distances as accurately from the projected image as in an actual situation. The wires 46 and 54 are so small in diameter as to be virtually invisible and, therefore, do not appreciably affect the sharpness of the projected image or the player's view of it.

From the foregoing description, it is evident that the apparatus of the invention can be very useful for both practice and recreation for any golfer. The apparatus is extremely simple, relatively inexpensive to manufacture, portable and relatively maintenance free. When used in connection with suitable projectors and computers to assist in plotting the lie of each shot, an extremely sophisticated system results which will allow the golfer to "play" almost any golf course for which a suitable set of photographs can be obtained.

Having thus described a preferred embodiment of the invention, it will be obvious to those skilled in the art that various revisions and modifications can be made to the embodiment shown herein without departing from the spirit and scope of the invention. It is the inventor's intention, however, that all such revisions and modifications as are obvious to those skilled in the art will be included within the scope of the following claims.

I claim:

1. An apparatus for predicating the flight and measuring the direction of a golf ball or the like hit by a player from an initial position in a player station by measuring the critical dimensions of the initial segment of the trajectory, said apparatus comprising a penetrable grid through which said ball travels, said grid having a first group of a plurality of spaced-apart electrical conducting wires positioned in the same first plane, a first supporting structure to which said wires are affixed, a second group of a plurality of spaced-apart electrical conducting wires positioned on said grid in the same second plane, a second supporting structure to which said wires are affixed, said first and second supporting structures being relatively positioned so that one of said planes is located closer to the player station than the other of said planes with the wires in said first plane extending transversely to the wires in said second plane, said first and second planes being spaced-apart so that the wires in one plane do not normally contact the wires in the other plane, means for securing the wires in each of said planes to their respective supporting structures so as to provide for limited movement of the wires without permanent deformation thereof within the range of limited movement, said limited movement being sufficient to permit the wires in each plane to separate and allow a ball to pass through the grid, the spacing of said first and second planes being within the range of said limited movement of said wires to provide for contact of a wire in the plane closer to the player station with a wire in the other plane when struck by a ball, and electrical detecting means to detect the point of contact of the first pair of wires one in each of said planes when a ball hit from said player station passes through said grid.

2. In the apparatus of claim 1, a penetrable grid in which the wires in each of said first and second planes are parallel to one another and equally spaced apart, the spacing of said wires in each of said planes being less than the diameter of the ball the flight of which is being determined.

3. In the apparatus of claim 2, a penetrable grid in which the wires in said first plane extend vertically and the wires in said second plane extend horizontally.

4. In the apparatus of claim 3, a penetrable grid in which said first and second planes are parallel to each other and are spaced apart less than an inch.

5. In the apparatus of claim 4, a penetrable grid in which the first plane containing the vertically extending wires is located closer to the player station than the second plane containing the horizontally extending wires.

6. In the apparatus of claim 1, a screen, and means by which a visual image can be projected on said screen, said screen also providing a backstop to absorb the impact of a moving ball, said wire grid being located closer to the player station than said screen and backstop.

7. In the apparatus of claim 1, an electrical circuit including sensing means located in said player station to measure certain dimensions of the initial part of the flight of the ball when struck by a player, said sensing means being combined with said detecting means to provide for measurement of the time required for the ball to reach said grid and to determine the point of penetration of the grid.

8. In the apparatus of claim 7 in which said sensing means includes a light source providing a beam of light and a light sensitive means in alignment with said light beam, said beam extending across the area in which the ball is placed prior to being struck by the player.

9. In the apparatus of claim 1, an electrical circuit including diodes, electrical leads connected through said diodes to each of the wires in said first group and to each of the wires in said second group, each of said wires being connected through said diodes to a units lead and to a tens lead, each pair of units and tens leads being connected in said circuit with said detecting means, said detecting means including latches to detect the contact of the first ones of the wires in said first and second planes.

10. In the apparatus of claim 9, means in said circuit for visually displaying the identity of the first ones of the wires to come into contact when struck by a ball and the time required for the ball to reach said grid.

* * * * *